United States Patent [19]

Lawes

[11] 4,093,114

[45] * June 6, 1978

[54] PLASTICS BAG

[75] Inventor: Norman Edward Lawes, Yarm, England

[73] Assignee: Imperial Chemical Industries Limited, London, England

[ * ] Notice: The portion of the term of this patent subsequent to Oct. 4, 1994, has been disclaimed.

[21] Appl. No.: 698,219

[22] Filed: Jun. 21, 1976

[30] Foreign Application Priority Data

Jul. 3, 1975 United Kingdom ..... 28046/75
Aug. 6, 1975 United Kingdom ..... 32851/75

[51] Int. Cl.[2] ..... B65D 5/60

[52] U.S. Cl. ..... 220/46.2; 229/62.5; 220/465

[58] Field of Search ..... 229/14 B, 62.5; 150/9

[56] References Cited

U.S. PATENT DOCUMENTS

| | | | |
|---|---|---|---|
| 3,297,226 | 1/1967 | Scholle | 220/465 X |
| 3,833,166 | 9/1974 | Murray | 229/62.5 |

FOREIGN PATENT DOCUMENTS

| | | | |
|---|---|---|---|
| 709,244 | 5/1965 | Canada | 229/62.5 |

*Primary Examiner*—Stephen P. Garbe
*Attorney, Agent, or Firm*—Cushman, Darby & Cushman

[57] ABSTRACT

A packaging container comprising a stiff outer casing and a plastics-film liner, the liner comprising a plastics-film bag having one wall formed by overlapping panels, with a filling valve formed in specified manner between the panels in the overlap.

10 Claims, 7 Drawing Figures

PLASTICS BAG

This invention relates to a packaging container. More particularly, the invention relates to a packaging container for flowable materials, especially for liquids, semi-solids or free-flowing powders or granules.

In accordance with the present invention, a packaging container comprises a stiff outer casing and a plastics-film liner, the liner comprising a plastics-film bag of one or more plies, closed at each end and having one wall formed by overlapping panels joined by a longitudinal seal, and having a filling valve comprising an inlet provided by an interruption in the longitudinal seal and a passageway formed between the outer panel on one side and the inner panel optionally with an extension thereof on the other, the inner panel together with any extension thereof providing at least two non-coextensive layers, free at their end edges, forming the inner wall of the passageway, and the sides of the passageway being defined by transverse seals extending from the longitudinal seal at each side of said interruption and joining the outer panel to the inner panel and any extension thereof.

The liner may be generally of a single-ply or multi-ply construction; two-ply or single-ply liners are usually preferred, since they are very easily made.

The inner wall of the valve passageway may be formed by only two non-coextensive layers, and in such case the liner may advantageously be a bag of the type particularly described in United Kingdom Specification No. 1,367,001, the bag being formed throughout essentially from a two-ply web. This bag has overlapping panels with filling valve formed between them in the manner hereinbefore described, the outer panel preferably being edged by a fold and the inner panel having its inner ply extending beyond its outer ply in the common area of the panels (and joined to the outer wall by a second longitudinal seal parallel to the first) so that the inner wall of the valve passageway is initially of two plies, but ends with a single ply that provides a flexible internal seal for the valve. Alternatively, a single-ply bag of similar construction may be modified to provide a similar liner by the addition of a layer of flexible material sealed to the inner panel of the overlap along a line spaced from the edge thereof.

Preferably, however, the inner wall of the valve passageway in the liner of the container of the present invention is formed by at least three non-coextensive layers. Such an arrangement is especially preferred when the liner is required to contain a liquid, to ensure that the valve is leak-proof.

Particularly suitable for use as liners for containers in accordance with the present invention are the valved bags described in an application filed concurrently with this application. That application describes a valved bag formed from a length comprising at least one layer of plastics film, the length being folded and joined to provide a bag having one wall formed by overlapping panels,, the ends of the bag being closed, and the overlapping panels being joined together by a longitudinal seal located with respect to the outer panel along the edge region thereof, this seal being interrupted to provide a valve opening, and by transverse seals at each side of the valve opening, said transverse seals defining a passageway constituting a filling valve between the panels, and there being included among the layers of film in the area of overlap, at least throughout the valve region, at least one layer of flexible material additional to the layer or layers forming the folded length, said additional layer or layers being joined with the panels into the transverse seals and preferably also into said longitudinal seal, the arrangement being such that the inner panel and said additional layer or layers provide, in the area of overlap, at least three layers extending non-coextensively along the valve passageway.

The valve opening may be located at one end of the bag, in which case one of the said transverse seals across the area of overlap may be provided as a portion of a seal closing that end of the bag. The bag may be side-gusseted if desired.

The invention gives the particular advantage that it provides a particularly secure valve arrangement, such that the lined container may be used to contain liquids or flowable semi-solid substances, even when the liners are of high capacity, for example of a capacity of at least 5 liters, and especially of 10 liters or more. The lined containers, particularly when they are of such high capacity, are also useful for containing free-flowing powders or granules, especially when these are of corrosive substances such as caustic soda.

The liners may be made in a conventional bag-making manner, by suitably folding a continuous web of plastics film, heat-sealing the overlapping panels together longitudinally and transversely as required for successive liners, and sealing and severing successive liners at intervals of one liner length. Any further strips or patches required in addition to the layers of the web may be fed in, between appropriate layers of the overlapping panels, before the panels are sealed together. It is to be understood that the terms "length" and "width", and related terms, are generally used in the context of bag manufacture, and will be used throughout this specification, in relation to the web from which the liners are made, rather than to the dimensions of an individual liner as such. Thus, for example, the "length" of film folded to form a liner is measured in the machine direction of the web; it may be, and generally will be, less than the width of the web. It follows that in the individual liner the "width" may sometimes be greater than the "length" (which is the distance from one line of severance to the other) and an "end" longer than a "side".

The stiff outer casing of the packaging container of the present invention may be a rigid container such as a metal drum or a wooden box, but will more usually be a cardboard carton or like container, since one of the advantages provided by the invention is in the replacement of expensive metal and wooden containers by containers of cheaper materials. The valve of the liner will generally be most conveniently located at or towards the centre of the length of the liner, when the liner is inserted sideways into the outer casing, and at a position in the width of the liner such that it will lie towards one side of the outer container when in position for filling. One form of liner particularly preferred when the outer container is a carton opening at one of its major faces has the form of side-gusseted bag, the depth of the gussets from an external fold to the internal fold preferably being approximately equal to half the depth of the carton, with the valve opening close to one external fold of the gusset in the central part of the length of the liner, and the valve passageway directed towards the centre of the upper wall of the liner.

In one preferred form of the liner, a J-folded strip of plastics film is used to provide two additional layers in the valve of a two-ply bag, the folded side of the strip being included in the longitudinal seal that lies along the edge of the outer panel and its two edges projecting unequally between the panels. The J-folded strip is positioned with its fold between the two layers of the inner panel, and both its edges project beyond the edge of the outer layer of the inner panel, with the shorter portion of the J adjacent to this outer layer, but stop short of the edge of the inner panel.

The invention will now be more particularly described by way of example with reference to the accompanying drawings, of which:

The film layers in the sections are shown as single lines.

Figure 1:
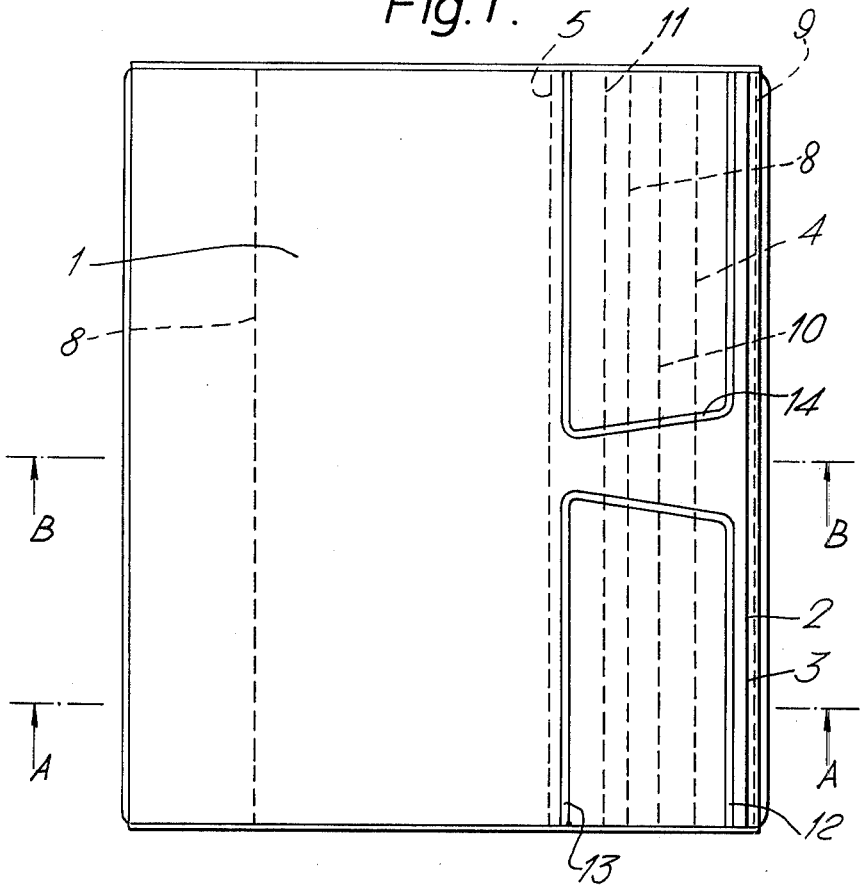
FIG. 1 is an elevational view of a two-ply, side-gusseted bag suitable for use as the liner, having a J-folded strip of flexible material to provide additional layers in the valve.
Figure 2:
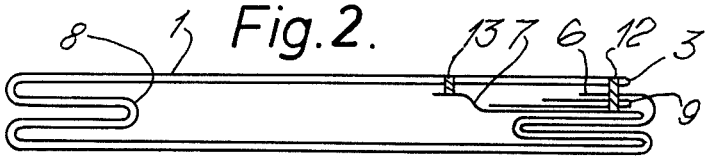
FIG. 2 is a section through A—A of FIG. 1.
Figure 3:
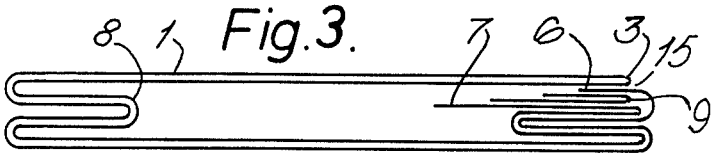
FIG. 3 is a section through B—B of FIG. 1.

In FIGS. 1 to 3: 1 is the outer panel and 2 is the inner panel of the front wall of the bag; 3 is a fold joining the inner and outer layers of the outer panel; 4 and 5 are respectively the edges of the outer ply, 6, and of the inner ply, 7, of the inner panel, the inner ply extending beyond the outer ply; and 8 is an inside fold of a gusset. 9 is the fold of a J-folded strip of film, which is interposed between the outer and inner layers of the inner panel, with its fold lying between the layers, and its two edges 10, 11, projecting beyond the edge, 4, of the outer layer of the panel but each lying short of the edge, 5, of the inner layer, and the shorter ply of the J-folded strip lying adjacent to the outer layer of the inner panel. The J-folded strip could alternatively be a single-layer strip. Two U-shaped seals, with legs 12 and 13, and with arches 14, join all layers in the area of overlap, the leg 12 thus joining together the two layers of the outer panel 1, the two layers of the inner panel 2, and the two layers of the interposed J-folded strip of film, and the leg 13 joining together the two layers of the outer panel and the inner layer of the inner panel only. Between the arches, 14, of the U-shaped seals the layers in the area of overlap are left unjoined to leave a transverse passageway, with an entry shown at 15 (FIG. 3), which provides a filling valve. The arches 14 of the U-shaped seals provide transverse seals defining the valve passageway. The position of this valve makes the bag particularly useful as a liner for a carton or box for containing semi-solid or liquid product.

Figure 4:
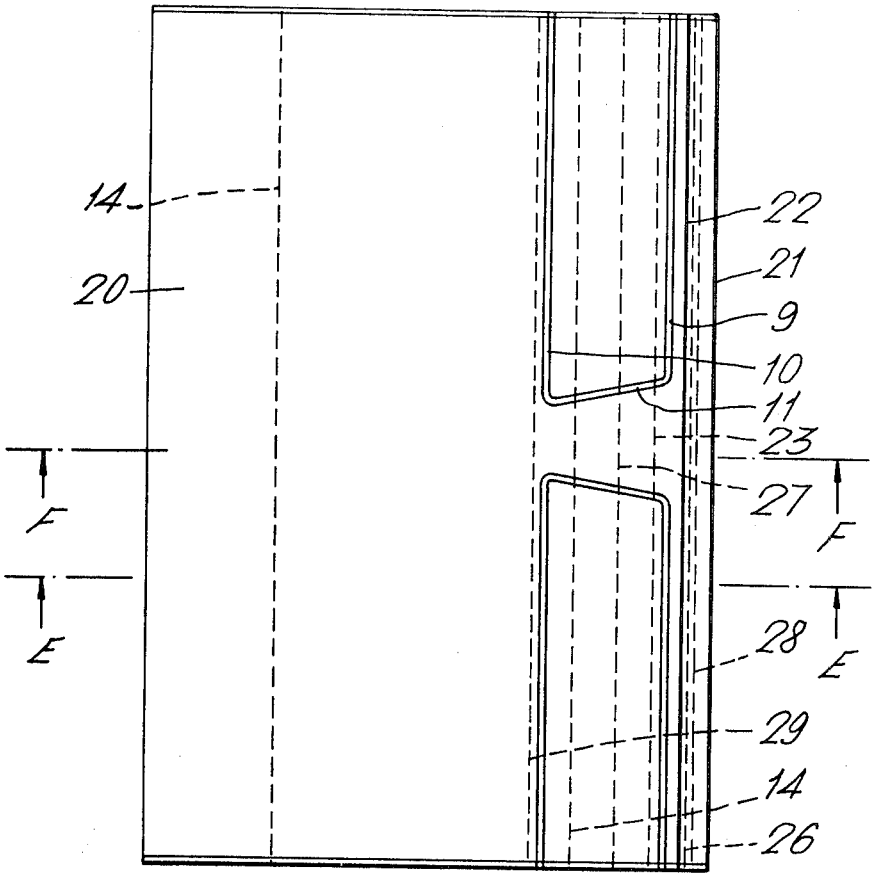
FIG. 4 is an elevational view of a single-ply bag also suitable for use as the liner, this bag having two additional layers in the valve.
Figure 5:
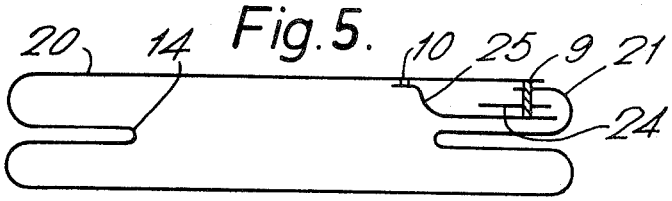
FIG. 5 is a section through C—C of FIG. 4.
Figure 6:
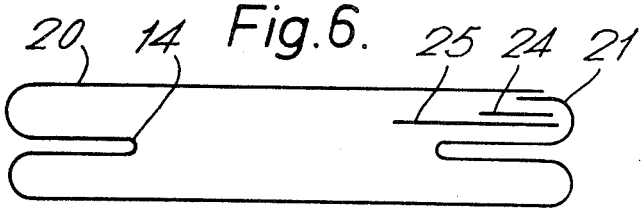
FIG. 6 is a section through D—D of FIG. 4.

In FIGS. 4 to 6: 20 is the outer panel and 21 is the inner panel of the front wall of the single-ply bag, the edge of the outer panel being shown at 22 and the edge of the inner panel at 23. 24 and 25 are two strips of plastics film each having one edge underlying the edge of the inner panel, and the other projecting beyond the edge of the inner panel towards the middle of the bag. The edges of strips 24 and 25 are shown at 26, 27 and 28, 29 respectively. Thus each side edge of the inner strip, 25, extends beyond the corresponding edge of strip 24. 9, 10, and 11 are again the parts of substantially U-shaped seals joining together the appropriate layers of film in the area of overlap: thus, panels 20 and 21 and strips 24 and 25 are all joined into parts 9 and 11 of the seal, but part 10 of the seal joins together only the outer panel 20 and the inner edge of strip 25.

Figure 7:
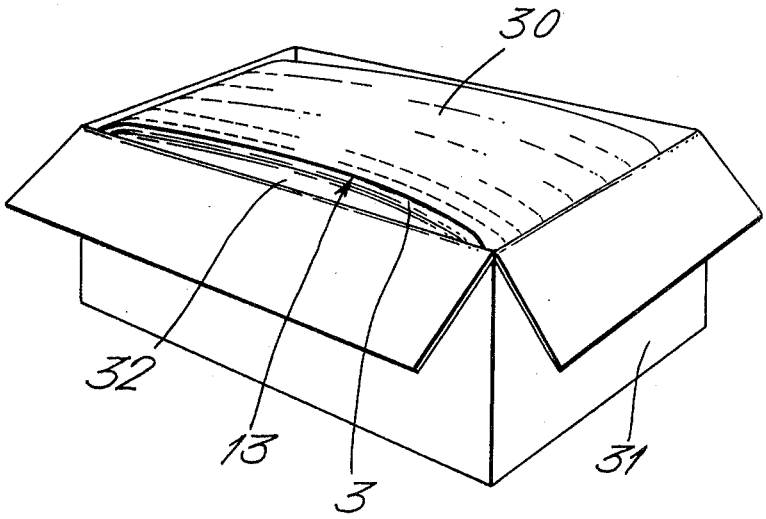
FIG. 7 shows a cardboard carton with a filled liner in position.

In FIG. 7: 30 is the liner which is of the type illustrated by FIGS. 1 to 3, fully filled and contained in a carton, 31. The edge of the outer panel of the front wall of the liner is shown at 3, and the valve is located centrally, at 15. 32 is one of the side gussets of the liner.

By way of example, a typical liner of the type illustrated by FIGS. 1 to 3 or 4 to 6 of the drawings has a length of 62.0 cms, a flat width of 40.0 cms, and gusset folds 5.0 cms deep, providing a capacity of 25 liters.

Various modifications may be made in the liners particularly described. For example, the valve may be located at one end of the liner instead of in the central position, especially if the liner is required for a container that opens or is open at one end, such as a drum or the like.

In the liners shown in the drawings the additional layer or layers extend down the whole length of the liner, and this arrangement has the advantage that the production of such liners involves only a very simple modification of standard bag-making equipment. The valves may alternatively be formed by inserting a separate piece or pieces for each liner, in the region bridging the valve only, these pieces being joined to both the opposed panels at least by the said transverse seals. This alternative construction requires further equipment for manufacture, but has the advantage of using less material.

For use in making the liner, films of olefine polymer or copolymer, of polyvinyl chloride, or of polyurethane are very suitable. Film of low-density ethylene polymer or copolymer is particularly suitable because of its inherent heat-sealability, its toughness and its low cost.

The said additional layer of flexible material is preferably, but not necessarily, of plastics material, and for liners intended to be suitable for containing liquids or semi-solids is preferably a smooth-surfaced plastics film, advantageously of the same plastics material as the walls of the liner (since this will facilitate its inclusion in the seal) but thinner than the overall thickness of the liner walls, and, in the case of two-ply or multi-ply liners, preferably thinner than the plies. For other applications, for example to allow a limited amount of breathing in a liner filled with powder or granules, the additional layer may be, for example, a non-woven, bonded plastics fabric, a pile-surfaced plastics-film laminate, a foamed plastics film, or paper. The layer is preferably heat-sealable to the panels of the liner, and the panels to each other, either directly or through a heat-sealable coating thereon. It is however possible to form the seals by means of an adhesive, for example by a hot-melt adhesive extruded as filaments or otherwise applied between the layers to be sealed.

The liners may be made by a continuous process, from flat plastics film or from tubular film of appropriate width, folded to the appropriate form. When tubular film is used to make two-ply liners of the type already described, one wall of the tubing may be slit longitudinally at a predetermined distance from one fold, and that fold thereafter unfolded. A longitudinally folded web results, having one ply somewhat wider than the other, which will provide a single extending ply in the overlap. Such a web may of course alternatively be formed by longitudinally folding a length of single sheet of the film. The web, irrespective of its number of plies, may be folded by passing it over a suitable A-frame where it is folded longitudinally to form a tubing adapted to form the back wall and the overlapping front panels of the liners. The additional strip, folded strip or strips of film may be fed continuously into position between the overlapping portions of the web. Alternatively, means may be provided for sealing separate pieces to the web at the required intervals. The area of overlap between the front panels is then provided at regular longitudinal intervals with the required longitudinal and transverse seals, formed against a mandrel, to join them together and to provide the valve passageways of successive liners. The web is finally transversely sealed and cut at regular intervals to provide successive liners.

I claim:

1. A packaging container comprising a stiff outer casing and a plastics-film liner, the improvement consisting in that the liner is a valved bag formed from a length comprising two plies of plastics film, the length being folded and joined to provide a bag having one wall formed by overlapping panels, the ends of the bag being closed and the overlapping panels being joined together by a longitudinal seal located along the edge region of the outer panel, the longitudinal seal being interrupted to provide a valve opening with transverse seals at each side of the valve opening defining a passageway constituting a filling valve between the panels, the outer panel comprising the two plies with their edges coextensive and the inner panel comprising the two plies together with at least one layer of flexible material in addition to said two plies at least throughout the valve region, the two plies and the additional layer which comprise the inner panel being arranged with their edges staggered such that all three edges may contact the inner ply of the outer panel, the additional layer being joined to the two plies of the inner panel at least by the transverse seals and being located with at least one of the plies of the inner panel lying between the additional layer and the outer panel in the area of overlap.

2. A packaging container as claimed in claim 1 in which the additional layer of flexible material extends longitudinally from one closed end of the bag to the other.

3. A packaging container as in claim 1 wherein the outer casing is a cardboard carton.

4. A packaging container as in claim 1 in which the additional layer of flexible material lies with one of its edges between said two plies of film of the inner panel and with its other edge projecting beyond the edge of the outer ply, but lying short of the edge of the inner ply, of the inner panel.

5. A packaging container as in claim 4 in which said outer panel is edged by a fold.

6. A packaging container as in claim 4 in which the edge of said inner ply of the inner panel is joined to the outer panel by a second longitudinal seal between the panels.

7. A packaging container as in claim 1 wherein the bag includes two said additional layers of flexible material provided by a J-folded strip of the material, the margin thereof that contains the fold being joined into said longitudinal seal and the two free edges thereof projecting unequally into the valve passageway.

8. A packaging container as in claim 1 in which each said additional layer of flexible material is of smooth-surfaced plastics film thinner than the overall thickness of the bag wall.

9. A packaging container as in claim 1 in which said additional layer or layers of flexible material are air-permeable.

10. A packaging container as in claim 1 wherein the bag is formed from a length comprising at least one layer of a plastics film and at least one layer of a different plastics film or of another flexible material.

* * * * *

UNITED STATES PATENT OFFICE

CERTIFICATE OF CORRECTION

Patent No. 4,093,114 Dated June 6, 1978

Inventor(s) Norman Edward Lawes

It is certified that error appears in the above-identified patent and that said Letters Patent are hereby corrected as shown below:

The disclaimer statement should read

--The portion of the term of this patent subsequent to February 14, 1995, has been disclaimed.--.

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*